US007503146B2

(12) United States Patent
Thomas

(10) Patent No.: US 7,503,146 B2
(45) **Date of Patent: *Mar. 17, 2009**

(54) COVERS, SYSTEMS, AND METHODS FOR COVERING OUTDOOR DECK COMPONENTS

(75) Inventor: Rodney H. Thomas, Town and Country, MO (US)

(73) Assignee: The Wilson Family Trust, Town & Country, MO (US), created by the Irrevocable Trust Agreement dated Jan. 1, 2003 by and Between Dawn S. Thomas as Grantor and Rodney H. Thomas and as Trustee ( * ) Notice: Subject to any disclaimer, the term of this patent is extended or adjusted under 35 U.S.C. 154(b) by 494 days.

This patent is subject to a terminal disclaimer.

(21) Appl. No.: 11/355,229

(22) Filed: Feb. 15, 2006

(65) Prior Publication Data

US 2006/0156640 A1 Jul. 20, 2006

Related U.S. Application Data

(63) Continuation-in-part of application No. 10/662,205, filed on Sep. 12, 2003, now Pat. No. 7,007,437.

(60) Provisional application No. 60/495,969, filed on Aug. 18, 2003.

(51) Int. Cl.
*E04C 2/38* (2006.01)

(52) U.S. Cl. ..... 52/177; 52/650.3; 52/511; 52/512

(58) Field of Classification Search ..... 52/650.3, 52/650, 773, 511, 512, 510, 177, 178, 179, 52/180, 483.1, 716.2, 489.1
See application file for complete search history.

(56) References Cited

U.S. PATENT DOCUMENTS 2,178,388 A * 10/1939 Beckman ..... 52/514
3,128,851 A 4/1964 Deridder et al.

(Continued)

FOREIGN PATENT DOCUMENTS

GB 2 167 463 5/1986

(Continued)

OTHER PUBLICATIONS 2 pages entitled *LockDry Aluminum Decking*.

(Continued)

*Primary Examiner*—Richard E Chilcot, Jr.
*Assistant Examiner*—Chi Q Nguyen
(74) *Attorney, Agent, or Firm*—Harness, Dickey & Pierce, P.L.C.

(57) ABSTRACT

According to various aspects of the present disclosure, there are provided various exemplary embodiments of covers, systems and methods for covering boards and deck components. In one exemplary embodiment, a cover generally includes an upper portion and generally downwardly extending side portions. The cover's upper and side portions are configured to generally cover at least the top and sides of the outdoor deck component. The cover's side portions may include through-holes to allow venting of moisture from an area between the cover and the outdoor deck component when the cover is positioned on the outdoor deck component.

21 Claims, 11 Drawing Sheets

U.S. PATENT DOCUMENTS

| | | | | |
|---|---|---|---|---|
| 4,593,506 | A | 6/1986 | Hartman et al. | |
| 4,703,597 | A | 11/1987 | Eggemar | |
| 4,885,882 | A | 12/1989 | Forshee | |
| 4,907,387 | A | 3/1990 | Turnbull | |
| 4,951,992 | A | 8/1990 | Hockney | |
| 5,050,362 | A | 9/1991 | Tal et al. | |
| 5,070,664 | A * | 12/1991 | Groh et al. | 52/177 |
| 5,326,187 | A | 7/1994 | St. Marie et al. | |
| 5,332,602 | A | 7/1994 | Barre et al. | |
| 5,351,458 | A | 10/1994 | Lehe | |
| 5,448,865 | A | 9/1995 | Palmersten | |
| 5,474,831 | A | 12/1995 | Nystrom | |
| 5,509,244 | A | 4/1996 | Bentzon | |
| 5,613,339 | A | 3/1997 | Pollock | |
| 5,692,345 | A | 12/1997 | Mogaki et al. | |
| 5,735,097 | A | 4/1998 | Cheyne | |
| 5,775,048 | A | 7/1998 | Orchard | |
| 5,794,390 | A | 8/1998 | Oliveri et al. | |
| 5,816,010 | A | 10/1998 | Conn | |
| 5,833,386 | A | 11/1998 | Rosan et al. | |
| 5,901,518 | A | 5/1999 | Harkins | |
| 5,904,011 | A | 5/1999 | Biro | |
| 5,913,784 | A | 6/1999 | Hite | |
| D421,502 | S | 3/2000 | Felch et al. | |
| 6,044,598 | A | 4/2000 | Elsasser et al. | |
| 6,170,212 | B1 | 1/2001 | Suchyna et al. | |
| 6,260,328 | B1 | 7/2001 | Fowler et al. | |
| 6,374,555 | B1 | 4/2002 | Gusler | |
| 6,401,286 | B1 * | 6/2002 | Brenn | 14/73 |
| D459,818 | S | 7/2002 | Chaney et al. | |
| 6,584,748 | B2 | 7/2003 | Bresnahan | |
| 6,594,961 | B2 | 7/2003 | Leines | |
| 6,651,398 | B2 | 11/2003 | Gregori | |
| 6,688,054 | B2 * | 2/2004 | Pasterchick | 52/177 |
| 6,694,681 | B1 | 2/2004 | Andres | |
| 6,955,021 | B2 | 10/2005 | Thomas | |
| 7,007,437 | B2 * | 3/2006 | Thomas | 52/650.3 |
| 2002/0023395 | A1 | 2/2002 | Pasterchick | |
| 2005/0055923 | A1 | 3/2005 | Thomas | |
| 2005/0055924 | A1 | 3/2005 | Thomas | |

FOREIGN PATENT DOCUMENTS

| | | |
|---|---|---|
| WO | WO 2005/019522 A2 | 3/2005 |

OTHER PUBLICATIONS 7 pages entitled *LockDry Aluminum Decking, FSI Home Products Division, Installation Instructions*.

2 pages entitled *Anchor Decking Introduces Durable Deck—The Vinyl Retrofit Solution*, published at www.prweb.com/releases/1999/6/prweb8363.php.

6 pages entitled *Durable Deck Vinyl Decking*, published at www.coxlumber.com/decking2.html.

2 pages published at www.durabledeck.com/PRFiles/ProdRelease.htm.

* cited by examiner

COVERS, SYSTEMS, AND METHODS FOR COVERING OUTDOOR DECK COMPONENTS

CROSS-REFERENCE TO RELATED APPLICATIONS

This application is a continuation-in-part of presently allowed U.S. patent application Ser. No. 10/662,205 filed Sep. 12, 2003, which claims priority to U.S. Provisional Patent Application No. 60/495,969 filed Aug. 18, 2003. This application claims priority to PCT Patent Application No. PCT/US04/09361 filed Mar. 26, 2004, which claims priority to U.S. patent application Ser. No. 10/662,206 filed Sep. 12, 2003 (now U.S. Pat. No. 6,955,021 issued Oct. 18, 2005), presently allowed U.S. patent application Ser. No. 10/662,205 filed Sep. 12, 2003, and U.S. Provisional Patent Application No. 60/495,969 filed Aug. 18, 2003. The disclosures of the above applications are incorporated herein by reference.

FIELD

This present disclosure relates to covers, systems and methods for covering outdoor deck components.

BACKGROUND

The statements in this section merely provide background information related to the present disclosure and may not constitute prior art.

Decks are typically constructed of wood. These decks are often constructed using standard nails, screws, and other conventional construction techniques to secure the various component parts of the deck together. For example, nails are often used to secure the floorboards to support members and to construct other features of the deck. By way of further example, a deck may include side rails for enclosing the deck structure and/or integrated benches for providing seating.

Decks are often constructed of wood that has been chemically impregnated to retard decomposition. The treated wood typically includes various additives, some of which may be particularly harmful to children and pets. For example, treated wood commonly used in the past for constructing decks included arsenic, which is potentially dangerous to users of the deck.

In addition, extensive maintenance of wood components is normally required, particularly in geographic areas subject to extreme weather changes or harsh weather conditions (e.g., excessive rain or sunlight, etc.). For example, periodic treatment of the deck surface with a water sealer or similar protecting agent is normally required to slow damage to the deck (e.g., splitting of the wood, etc.) caused by weather conditions. Further, a stain or similar type of material for maintaining a desired color of the deck is often used, and typically requires periodic application. These protecting agents and stains add costs to the maintenance of the deck. Additionally, despite efforts to maintain the condition of the deck (e.g., sealing the deck yearly to inhibit damage, etc.), floorboards, railing boards, and other deck parts often must be replaced as a result of continuous exposure to outdoor elements.

Plus, the standard wood nails that are typically used with deck construction often loosen from the wood and become raised. In addition to their unsightliness, these raised nails can result in a potentially dangerous condition that may cause injury to users of the deck (e.g., injury to a user's foot while walking on the deck, etc.).

SUMMARY

According to various aspects of the present disclosure, there are provided various exemplary embodiments of covers, systems and methods for covering boards and deck components. In one exemplary embodiment, a cover generally includes an upper portion and generally downwardly extending side portions. The cover's upper and side portions are configured to generally cover at least the top and sides of the outdoor deck component. The cover's side portions may include through-holes to allow venting of moisture from an area between the cover and the outdoor deck component when the cover is positioned on the outdoor deck component.

Another aspect of the present disclosure includes systems for covering an outdoor deck component having first and second sides. In one exemplary embodiment, a system generally includes at least a first cover and at least first and second couplings. Each of the first and second couplings includes a channel, and is configured to engage a corresponding portion of the first cover for retaining the first cover on the outdoor deck component with a spaced distance separating the first cover from at least one other cover retained by the first or second coupling on an adjacent outdoor deck component. The spaced distance can allow liquid to flow off an upper surface of the first cover into the channel of the corresponding first or second coupling.

A further aspect of the present disclosure includes methods for covering at least a portion of an outdoor deck. In one exemplary embodiment, a method generally includes engaging a plurality of couplings with at least one joist of the outdoor deck such that each coupling is adjacent a corresponding side of at least one floorboard of the outdoor deck. The method can also include positioning a first cover on a first floorboard of the outdoor deck such that portions of the first cover are received and retained within the channels of the couplings adjacent the sides of the first floorboard. The method can further include positioning a second cover on a second floorboard of the outdoor deck such that portions of the second cover are received and retained within the channels of the couplings adjacent the sides of the second floorboard, and such that a spaced distance separates the first cover from the second cover. The spaced distance can allow liquid to flow off of the first and second cover's top portions into the channels.

Further aspects, features, and areas of applicability of the present disclosure will become apparent from the detailed description provided hereinafter. In addition, any one or more aspects of the present disclosure may be implemented individually or in any combination with any one or more of the other aspects of the present disclosure. It should be understood that the detailed description and specific examples, while indicating exemplary embodiments of the present disclosure, are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1A:
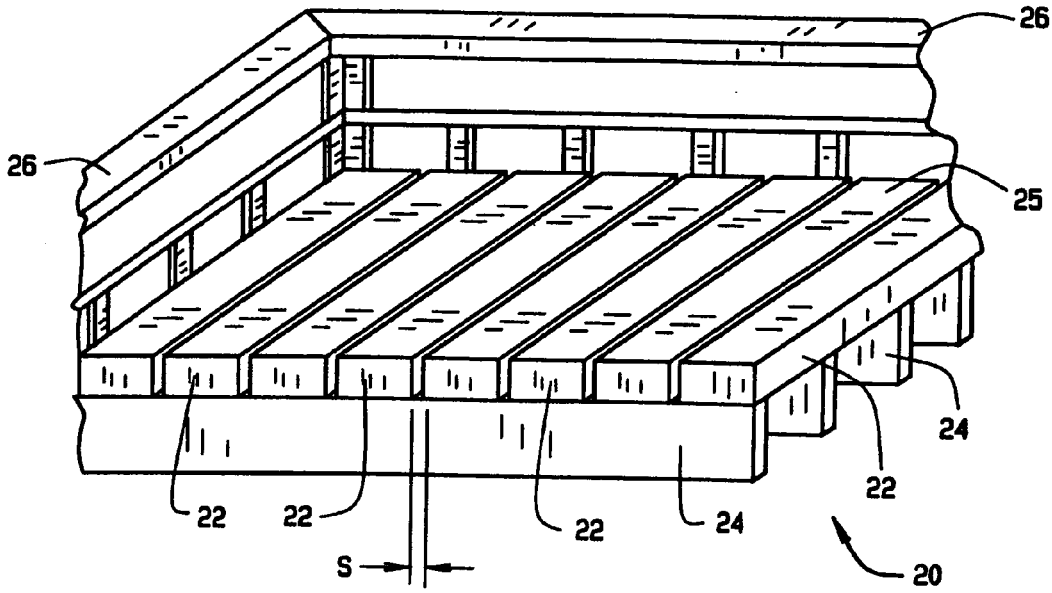
FIG. 1A is a partial top perspective view of an exemplary deck in conjunction with which embodiments of the present disclosure may be implemented.
Figure 1B:
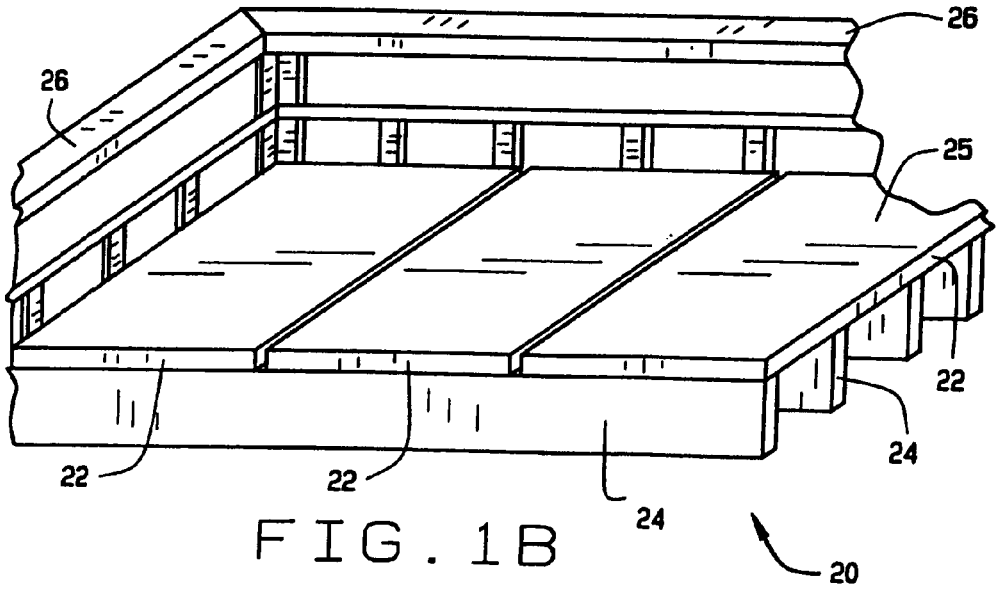
FIG. 1B is a partial perspective view of an exemplary deck constructed with plywood floorboards in conjunction with which embodiments of the present disclosure may be implemented.

FIGS. 1A and 1B illustrate exemplary decks 20 in conjunction with which at least some embodiments of the present disclosure may be implemented. As shown in FIG. 1A, the deck 20 includes a plurality of floorboards 22 of a conventional size, such as two-by-two (2×2), two-by-four (2×4) or two-by-six (2×6) inch boards. In FIG. 1B, the deck 20 is constructed with plywood floorboards 22, which are considerably wider and thinner than standard two-by-six inch boards.

In either of the decks 20 shown in FIGS. 1A and 1B, the floorboards 22 are typically secured to lower support boards or joists 24 to form a floor 25 of the deck 20. The floor area 25 is typically constructed such that a spacing (S) is provided between adjacent floorboards 22. Further, the deck 20 may include side railings 26 or other structures for enclosing the deck 20. Additionally, other add-ons may also be provided as part of the deck 20, for example, integrated seating areas or steps for accessing the deck 20.

The deck 20 is typically constructed using nails, particularly for securing the floorboards 22 to the lower support boards 24. Other suitable fastening methods may also be used, including, for example, screws and clips to secure the various parts of the deck 20.

Figure 2:
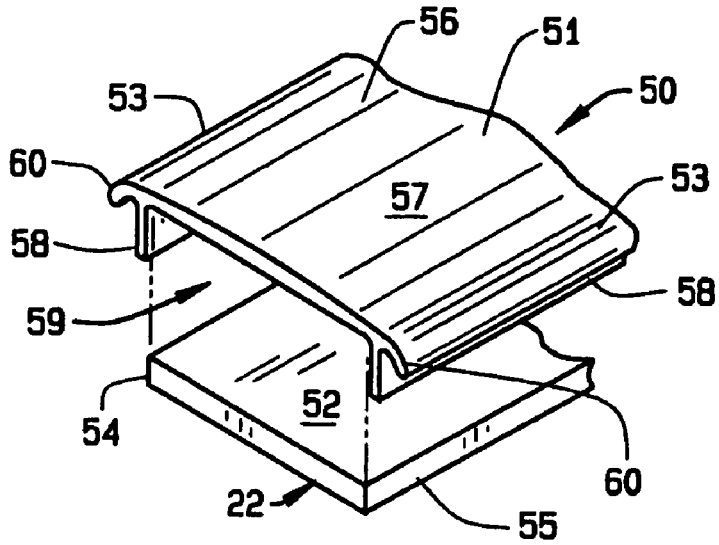
FIG. 2 is a perspective view of a cover according to one embodiment of the present disclosure.

FIG. 2 illustrates a cover 50 according to one embodiment that is generally adapted to be received over a plywood board 22 to generally cover at least the top 52 and sides 54, 55 of the plywood board 22. It should be noted, however, that the cover 50 can also be adapted for fitting over and engaging a railing board, step, integrated seat, among other deck components. It should also be noted that the cover 50 as well as the other various embodiments of the present disclosure can be used with different sizes and shapes of boards (e.g., 2×2, 2×4, 2×6 inch boards, plywood boards, plastic boards, etc.).

In the illustrated embodiment of FIG. 2, the cover 50 includes a top portion 56 and side portions 58 forming an interior 59. The interior 59 is sized to receive the plywood floorboard 22 therein, for example, to protect the floorboard 22 from external conditions (e.g., weather, wear and tear, etc.). The interior 59 has a cross-section or transverse profile that is generally an inverted U-shape or C-shape, the corners of which form substantially right angles. Other cross-sectional shapes are also possible for the interior 59 depending, for example, at least in part on the particular shape of board on which the cover 50 will be positioned.

As shown in FIG. 2, the cover 50 further includes an overhang or shroud 60 at each side edge 53 of the top portion 56. Each overhang 60 extends outwardly beyond the corresponding side portion 58 of the cover 50. Each overhang 60 is also shown curved generally downwardly and forms a drip edge that can facilitate, for example, the flow of liquid (e.g., water from rain or from cleaning the deck 20, etc.) off the top portion 56. Alternatively, the cover may include more or less overhangs and/or overhangs configured differently (e.g., sized, shaped, etc.) than what is shown in FIG. 2. For example, other embodiments include only one overhang, no overhangs, or one or more overhangs that are generally straight, that are generally horizontal, that extend generally diagonally in a downwardly direction, combinations thereof, etc.

To further facilitate the flow of liquid off the top portion 56, the cover's top portion 56 may include a middle portion 51 that is slightly thicker than the side edges 53 of the top portion 56. The thickness of the top portion 56 can decrease from its middle portion 51 to its side edges 53. This tapering can be up to about fifteen degrees, although other configurations can also be employed. In the illustrated embodiment of FIG. 2, the top portion 56 is provided with an upper surface 57 that slopes generally downwardly from its middle portion 51 towards its side edges 53. This, in turn, facilitates drainage off of the top portion 56 (and thus off the board 22 on which the cover 50 is positioned as well). In alternative embodiments, the cover may have an upper surface with a generally convex curvature for facilitating the flow of liquid off the cover's upper surface. The convex upper surface can be slightly rounded or curved from a longitudinal center line of the cover for shedding water, but which is still comfortable to walk upon.

In various embodiments, the cover 50 is adapted to be readily and easily installed on a board 22. In one exemplary embodiment, the side portions 58 of the cover 50 are generally straight and angled at least slightly inward to frictionally receive and grip the board 22 between the side portions 58. In one particular embodiment, the side portions 58 are resiliently biased inwardly toward the corresponding sides 54, 55 of the floorboard 22. The flexible tension grip of the side portions 58 onto the floorboard 22 inhibits the cover 50 from lifting off the floorboards 22 during normal use of the deck. This feature can also allow a user to readily, easily and quickly install ("snap into place") a cover 50 on a floorboard 22 without requiring the use of mechanical fasteners or tools. This feature can also allow for ready and easy removal of the cover 50 from the floorboard 22. For example, the cover 50 can be unsnapped off or unzipped from the floorboard 22 when the cover 50 is formed of sufficiently flexible material, such as vinyl, etc. Installing the cover 50 onto a floorboard 22 without fasteners can accommodate at least some contraction and/or expansion of the cover 50 relative to the board 22 within the cover 50. A cover 50 installed without fasteners may be able to shift or move relative to the board 22 as the cover 50 expands or contracts, where at least some mechanical fasteners may have otherwise inhibited such relative movement or shifting.

Figure 3:
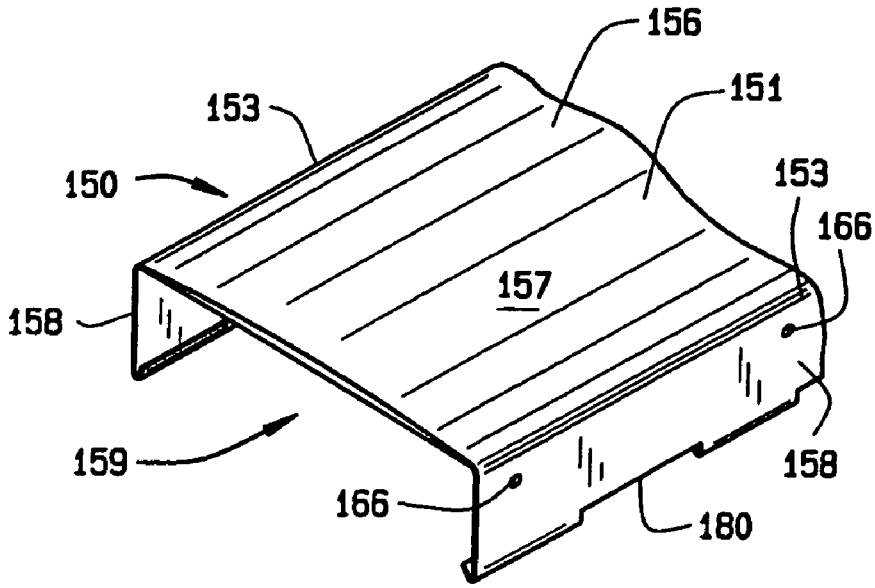
FIG. 3 is a perspective view of another embodiment of a cover of the present disclosure.
Figure 4:
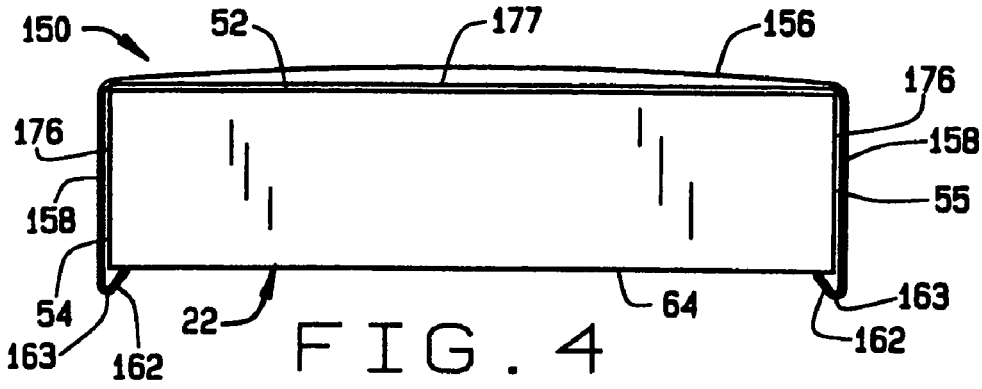
FIG. 4 is an elevation view of the cover shown in FIG. 3 positioned on a board.
Figure 5:
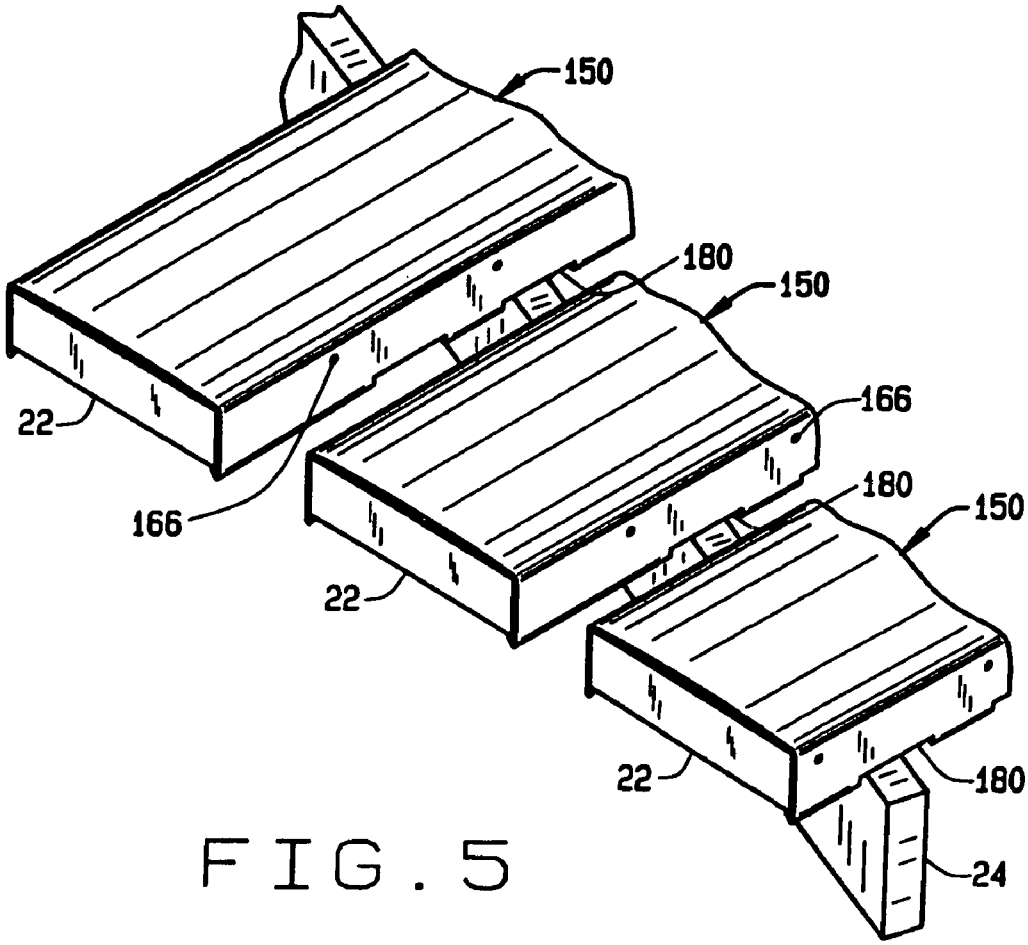
FIG. 5 is a perspective view of three covers as shown in FIGS. 3 and 4 positioned on boards.

FIGS. 3 through 5 illustrate a cover 150 according to another embodiment of the present disclosure. As shown, the cover 150 includes a top portion 156 and side portions 158 forming an interior 159 for protecting the floorboard 22, for example, from external conditions like weather. The upper surface 157 of top portion 156 may slope generally downwardly from the middle portion 151 towards the side edges 153.

As shown in FIG. 5, the side portions 158 further include slots or notches 180 for accommodating another board, such as a lower support board or joist 24, positioned below the board 22. The slots 180 are adapted to extend around portions of the lower support board 24 when the cover 150 is positioned on the board 22.

In the exemplary embodiment shown in FIGS. 3 and 5, each slot 180 has a cross-section that is generally an inverted U-shape or C-shape, the corners of which form substantially right angles. Other cross-sectional shapes and configurations can also be employed for the slots depending, for example, at least in part on the shape of the board or other deck component to be accommodated by the slots.

The slots 180 can be sized to accommodate a wide range of joist configurations, joist sizes and joist positioning conditions and angles relative to the floorboards. In at least one exemplary embodiment, each slot 180 is sized to accommodate joists positioned relative to the floorboards at various angles between about forty-five degrees and about ninety degrees. Additionally, or alternatively, the slots 180 can also be configured for accommodating at least some contraction and/or expansion of the cover 150 relative to board 22 and/or joist 24.

Figure 6:
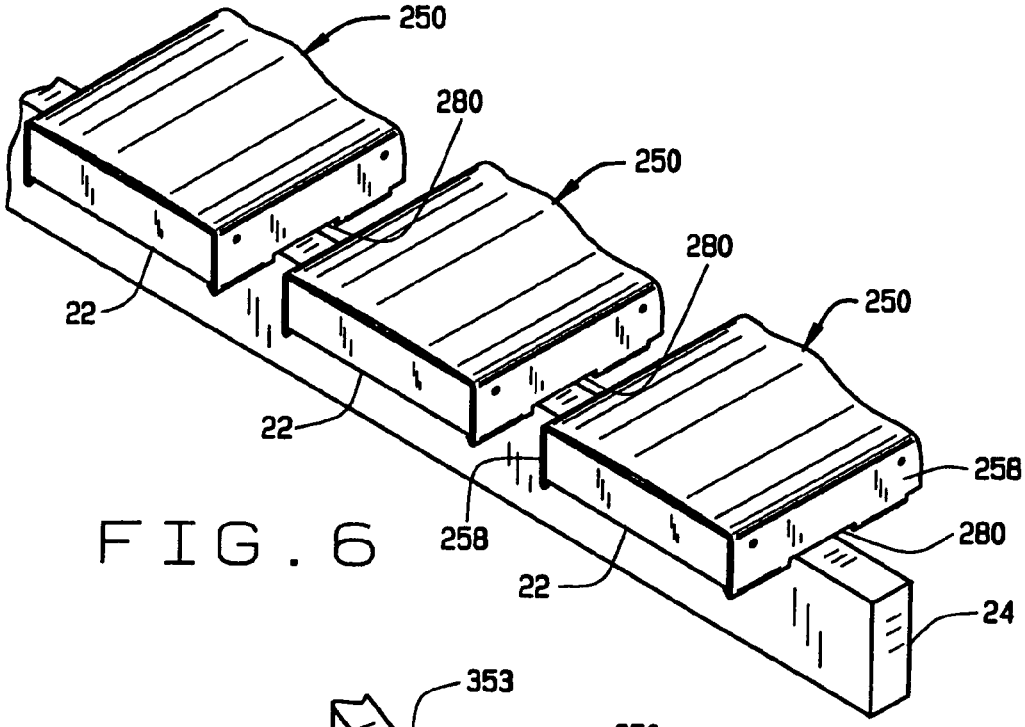
FIG. 6 is a perspective view of another embodiment of a cover illustrating three of such covers positioned on boards.

The slots 180 can be positioned to accommodate for different joist positioning conditions and angles relative to the floorboards. For example, the slots 180 can be staggered to accommodate a joist 24 forming an oblique angle (e.g., a forty-five degree angle, etc.) with the floorboards 22, as shown in FIG. 5. Or for example, the slots 280 on one side portion 258 can be aligned with the slots 280 on the other side portion 258 to accommodate a joist 24 that is generally perpendicular to the floorboards 22, as shown for the cover 250 in FIG. 6.

The configurations, dimensions, and locations of the slots may vary depending, for example, on the requirements of the particular application in which the covers will be used. In various embodiments, the slots are adapted to accommodate for all reasonably expected joist spacing and joist positioning conditions in a deck.

With further reference to FIG. 4, the side portions 158 include engagement portions 162 for engaging the bottom 64 of the board 22. In this particular embodiment, the engagement portions 162 comprise inward extensions having a generally U-shaped transverse profile. To provide an even more secure engagement with the board 22, each side portion 158 may be resiliently biased inwardly toward the corresponding side 54, 55 of the floorboard 22. The flexible tension grip of the side portions 158 onto the floorboard 22 inhibits the cover 50 from lifting off the floorboards 22 during normal use of the deck. A user can readily and quickly install ("snap into place") a cover 150 on a floorboard 22 without requiring the use of fasteners or tools, which can allow the cover 150 to be readily removed from the floorboard 22 and to accommodate (e.g., relative movement or shifting) at least some contraction and/or expansion of the cover 150 relative to the board 22. By way of example only, the cover 150 can be installed onto a board 22 without fasteners, such that the cover 150 may be able to shift or move relative to the board 22 as the cover 150 expands or contracts. In some embodiments, the cover 150 can be unsnapped off or unzipped from a floorboard 22 when the cover 150 is formed of sufficiently flexible material, such as vinyl, etc.

In the illustrated embodiment of FIGS. 3 through 5, the side portions 158 each include inwardly extending or bent portions 162 which have a cross-section or transverse profile that is generally U-shaped. Other cross-sectional shapes (e.g., L-shaped, etc.) are also possible depending, for example, on the particular application in which the cover 150 will be used. For example, in alternate embodiments, the cover's side portions may be generally straight without engagement portions or inward extensions, as shown in FIG. 2.

With continued reference to FIGS. 3 through 5, various embodiments include holes for allowing liquid to drain out of the engagement portions 162. In such embodiments, any suitable number of (i.e., one or more) holes or openings 163 can be provided in the bottommost portion of the u-shape.

In at least some embodiments, the cover 150 is sized at least slightly larger (dimensionally) than the board 22 on which the cover 150 will be positioned. For example, the cover 150 can be constructed slightly larger than the board 22 such that a gap 176 (e.g., one-sixteenth inch gap, etc.) is respectively defined between the cover's side portions 158 and the corresponding sides 54, 55 of the board 22. A gap 177 can also be defined between the cover's top portion 156 and the top 52 of the board 22. These gaps 176 and 177 can also accommodate and allow at least some contraction of the cover 150 relative to the board 22 within the cover 150.

As shown in FIGS. 3 and 5, the side portions 158 include openings 166 for venting vapor, liquid evaporating from under the deck, and/or moisture rising from the ground. The through-holes 166 allow the venting or escape of moisture that may otherwise become trapped within the interior 159 of the cover 150 and cause damage to the floorboard 22 or other deck components (e.g., rotting of wooden deck components, etc.).

Figure 7:
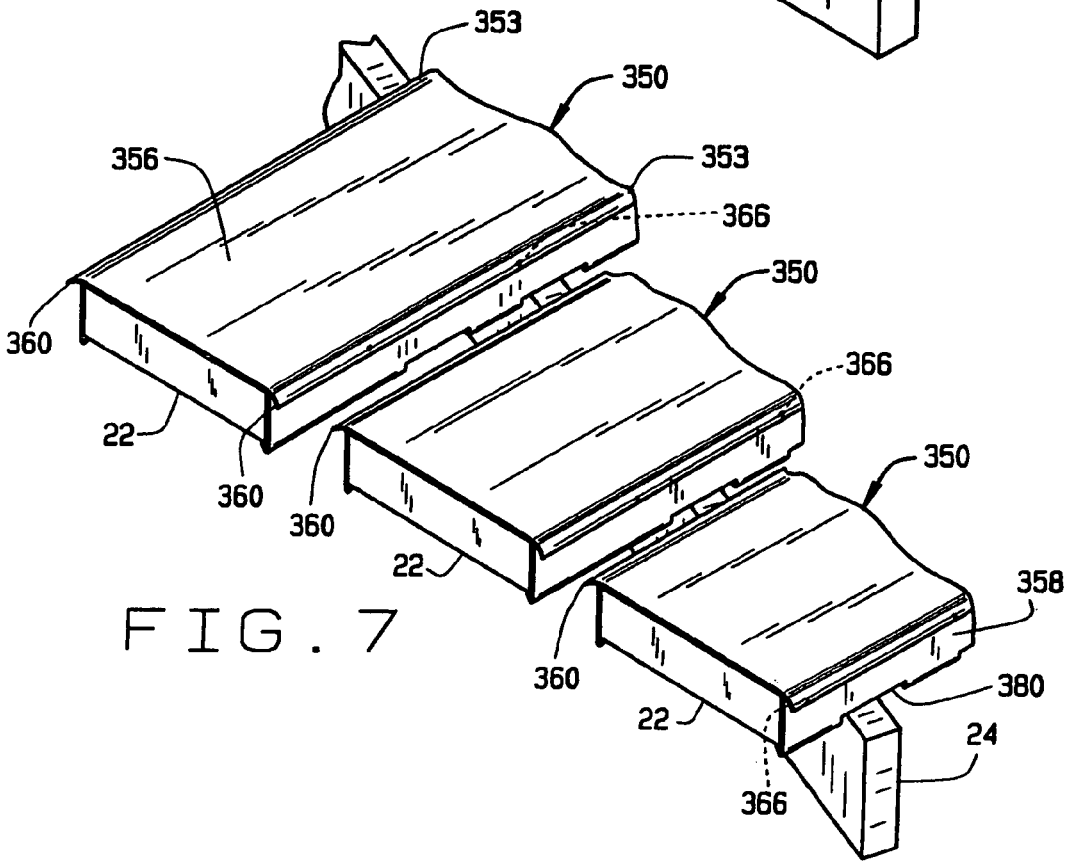
FIG. 7 is a perspective view of another embodiment of a cover illustrating three of such covers positioned on boards.

FIG. 7 illustrates another embodiment of a cover 350, which is adapted to accommodate the lower support board 24. As shown in FIG. 7, the cover side portions 358 have slots or notches 380 therein for accommodating the lower support board 24. The side portions 358 also include openings 366, which allow venting or escape of moisture trapped within the interior of the cover 350.

Overhangs 360 are also provided at each side edge 353 of the top portion 356. Each overhang 360 is curved generally downwardly and forms a drip edge that can facilitate the flow of liquid off the top portion 356. Alternatively, the cover may include more or less overhangs and/or overhangs configured differently (e.g., sized, shaped, etc.) than what is shown in FIG. 7. For example, other embodiments include only one overhang, no overhangs, or one or more overhangs that are generally straight, that are generally horizontal, that extend generally diagonally in a downwardly direction, combinations thereof, etc.

In the illustrated embodiment of FIG. 7, the overhangs 360 and the holes 366 are adapted such that the overhangs 360 project downwardly at least to the location of the holes 366. This allows the overhangs 360 to at least partially cover the holes 366, for example, to inhibit moisture (e.g., water from rain or from cleaning the deck) from entering the holes 366.

Figure 9:
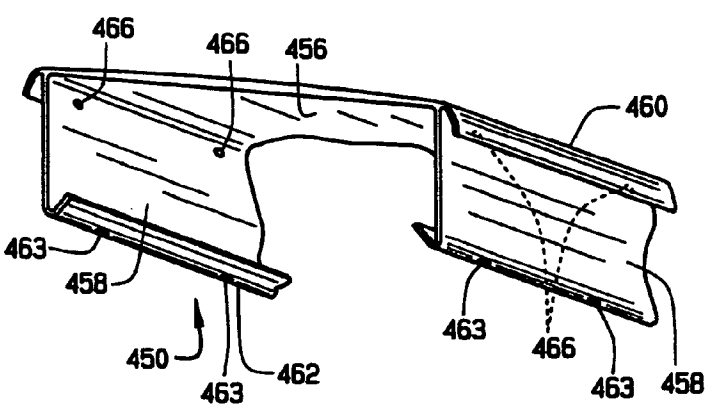
FIG. 9 is another perspective view of the cover shown in FIG. 8.
Figure 8:
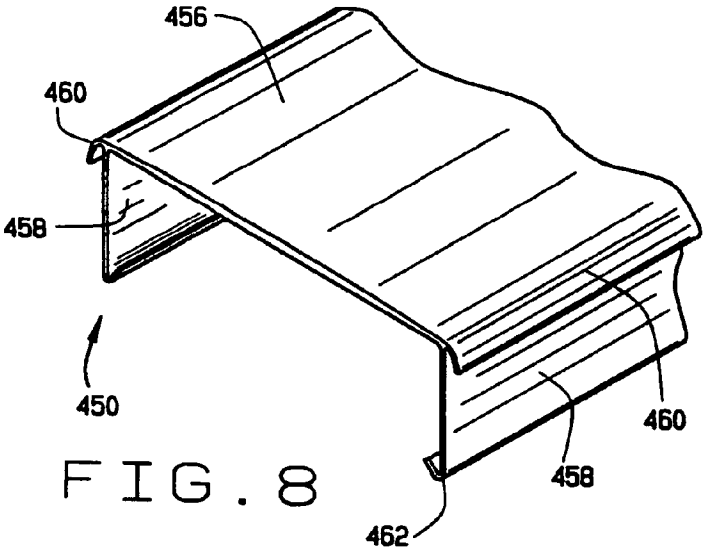
FIG. 8 is a perspective view of a cover according to another embodiment of the present disclosure.
Figure 10:
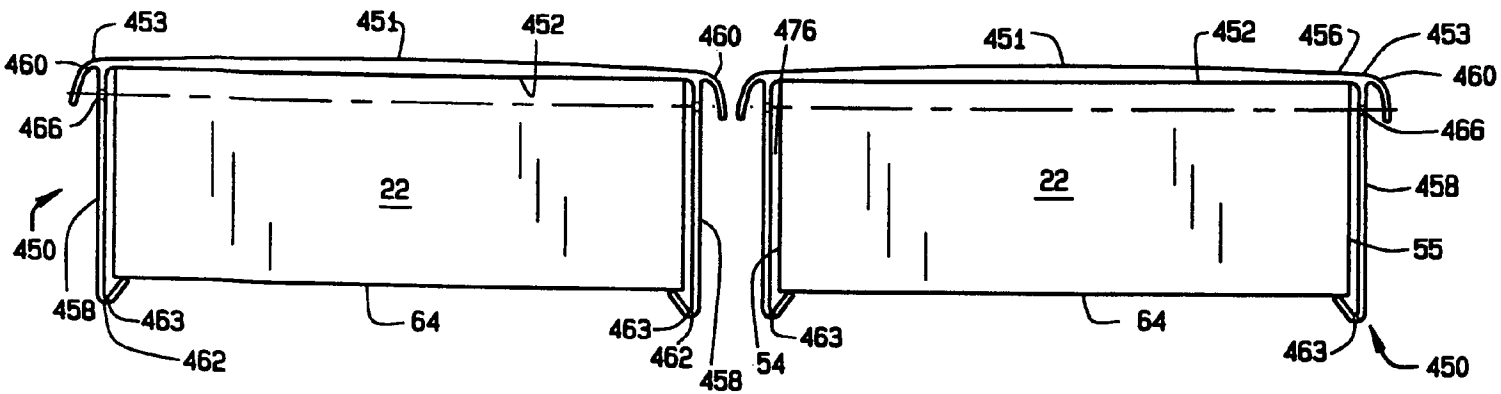
FIG. 10 is an elevation view of two covers as shown in FIGS. 8 and 9 positioned on boards.

FIGS. 8 through 10 illustrate another embodiment of a cover 450 that includes a top portion 456 and side portions 458. As shown, the side portions 458 includes inward extensions or inwardly bent portions 462 having transverse profiles or cross-sections that are generally U-shaped for engaging the board 22. Other cross-sectional shapes (e.g., L-shaped, etc.) are also possible depending, for example, on the particular application in which the cover 450 will be used. For example, in alternate embodiments, the cover's side portions may be generally straight without any inward extensions or inwardly bent portions as shown for the exemplary cover 50 in FIG. 2.

To allow liquid to drain out of the engagement portions 462, various embodiments can include any suitable number of (i.e., one or more) and configuration of openings or holes 463. In the illustrated embodiment of FIGS. 8 through 10, holes 463 are provided in the bottommost portion of the u-shape.

With continued reference to FIGS. 8 through 10, the cover 450 also includes a plurality of openings 466 provided in the side portions 458 for venting of vapor or moisture from the cover 450. The cover 450 also includes overhangs 460 curving generally downwardly from each side edge 453 of the top portion 456. The overhangs 460 form a drip edge that can facilitate the flow of liquid off the top portion 456. In this particular embodiment, the overhangs 460 project downwardly at least to the location of the holes 466. This allows the overhangs 460 to at least partially cover the holes 466, for example, to inhibit moisture (e.g., water from rain or from cleaning the deck) from entering the holes 466.

To further facilitate the flow of liquid off the top portion 456, the thickness of the top portion 456 decreases from its middle portion 451 to its side edges 453. The upper surface of the top portion 456 thus slopes generally downwardly or is beveled from its middle portion 451 towards its side edges 453.

Figure 11:
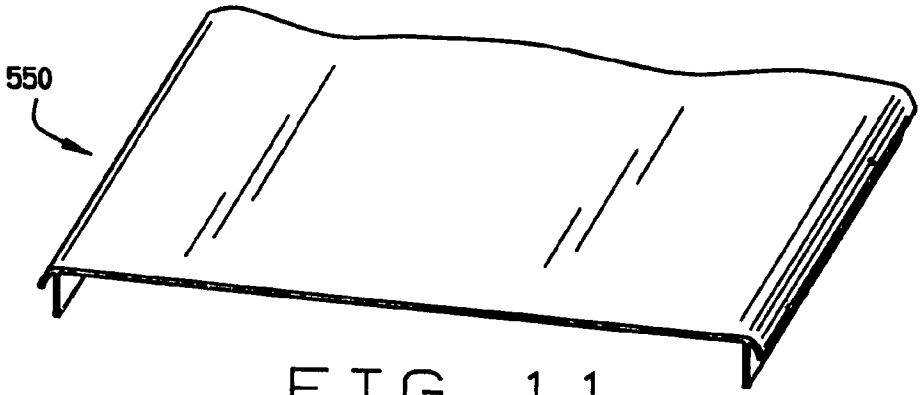
FIG. 11 is a perspective view of another embodiment of a cover of the present disclosure.
Figure 12:
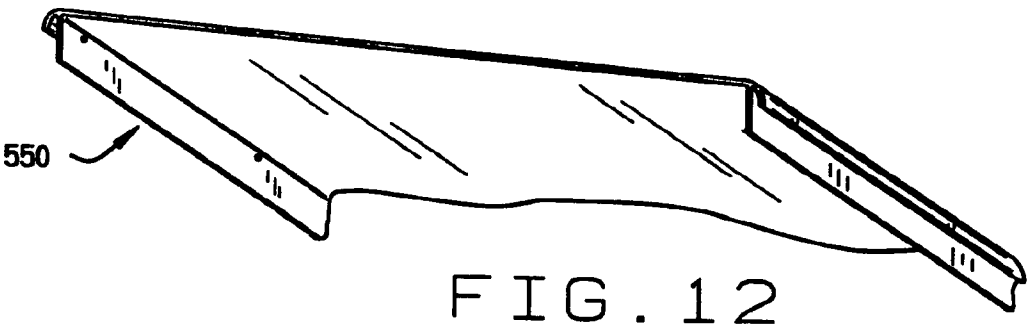
FIG. 12 is another perspective view of the cover shown in FIG. 11.
Figure 13:
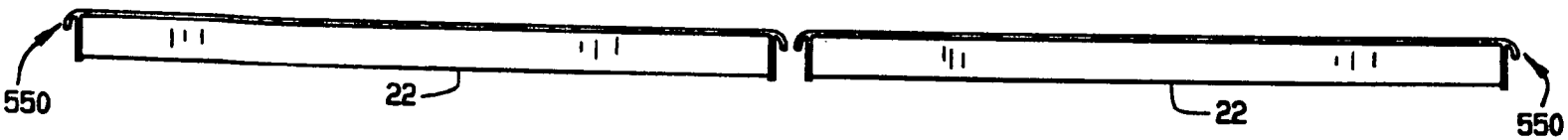
FIG. 13 is an elevation view of two covers as shown in FIGS. 11 and 12 positioned on plywood boards.

FIGS. 11 through 13 illustrate another embodiment of a cover 550 that includes overhangs and moisture venting holes. In this particular embodiment, the cover 550 is adapted for use with relatively wide slats of plywood floorboards 22, which are considerably wider and thinner than standard two-by-six inch boards.

Figure 14:
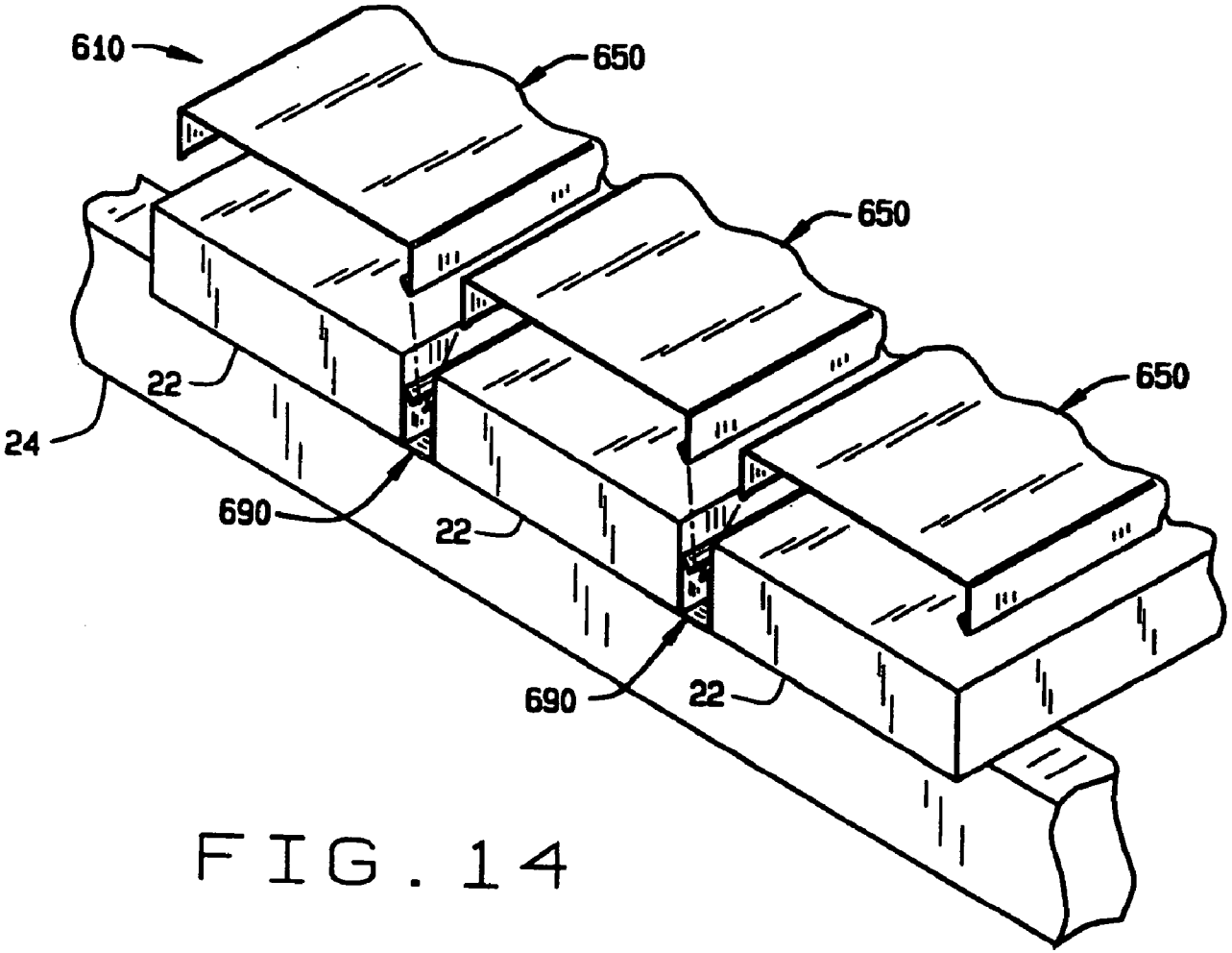
FIG. 14 is an exploded perspective view of a system for covering boards in a deck according to another embodiment of the present disclosure.
Figure 15:
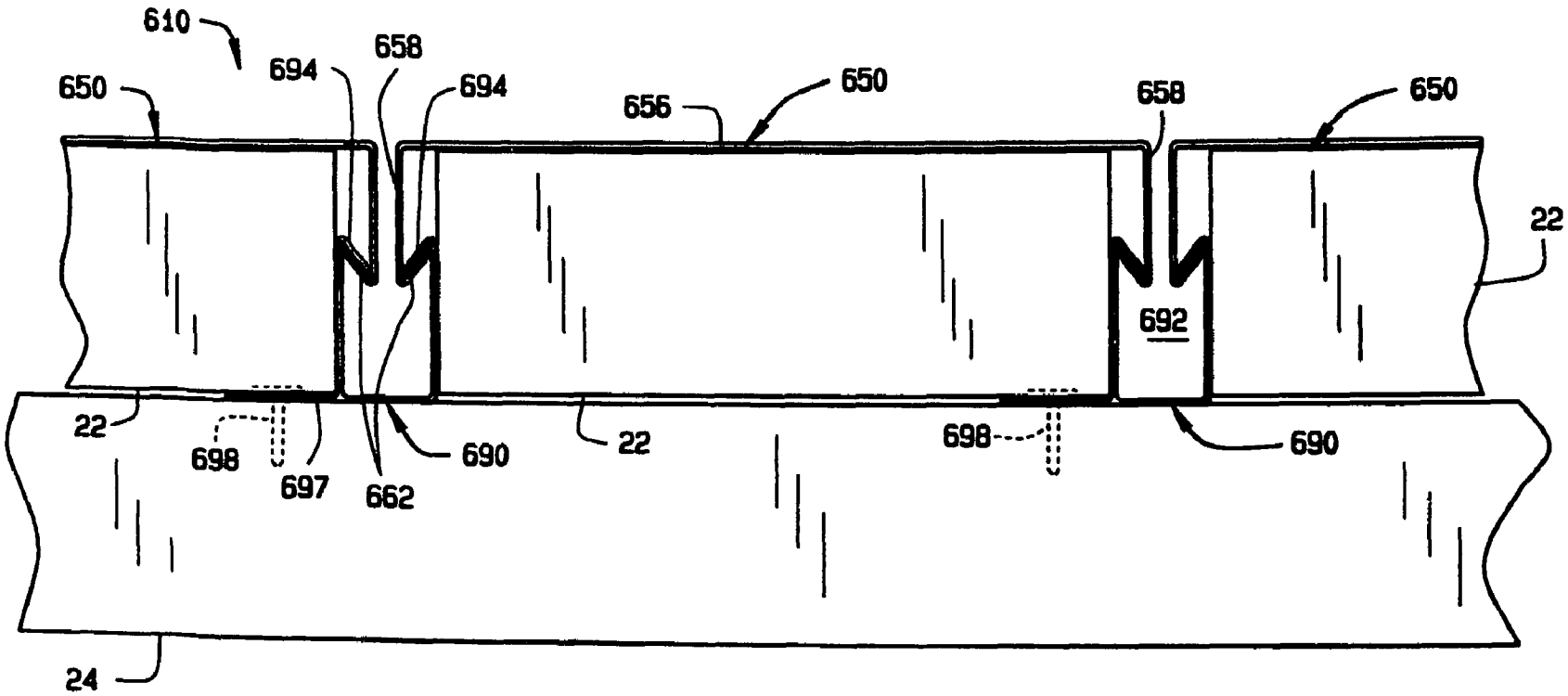
FIG. 15 is an elevation view of the system shown in FIG. 14.

FIGS. 14 through 15 illustrate a system 610 for covering boards (e.g., floorboards 22, etc.) in a deck, such as an outdoor patio deck, etc. As shown in FIGS. 14 through 15, the system includes covers 650 each of which includes a top portion 656 and side portions 658. The cover's top portion 656 may include an upper surface that slopes generally downwardly from its middle portion towards the side edges.

The system 610 further includes couplings 690 (FIGS. 16A and 16B) each of which is adapted to be coupled to at least one joist 24. Each coupling 690 is sized to be positioned between at least two adjacent floorboards 22. As shown in FIG. 15, each coupling 690 can be positioned in contact with and abutting the sides of the corresponding pair of floorboards 22 between which the coupling 690 is positioned. Accordingly, the couplings 690 can provide generally uniform and consistent spacing between the floorboards 22.

Figure 16A:
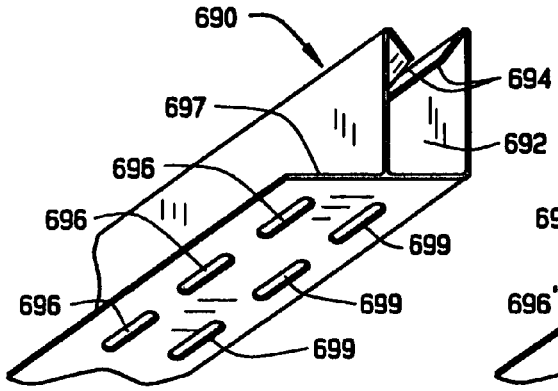
FIG. 16A is a perspective view of a coupling according to one embodiment of the present disclosure.
Figure 16B:
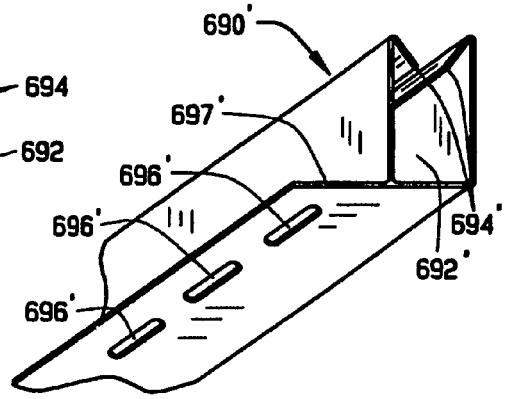
FIG. 16B is a perspective view of a coupling according to another embodiment of the present disclosure.

As shown in FIGS. 16A and 16B, each coupling 690 defines a channel 692 adapted to receive and retain therein inward extensions or inwardly bent portions 662 of the corresponding side portions 658. The side portions 658 and couplings 690 include interlocking or interengageable portions 662 and 694, respectively, that when engaged provide a relatively secure interlocking engagement between the covers 650.

In various embodiments, the engagement of the interlocking or interengageable portions 662 and 694 can sufficiently inhibit removal of a cover 650 from a board 622 such mechanical fasteners are not required or need to be used for keeping the covers 650 on the boards 22. In such embodiments, installing such covers 650 without mechanical fasteners can accommodate at least some contraction and/or expansion of the covers 650 relative to the boards 22 within the covers 650. For example, a cover 650 installed without fasteners may be able to shift or move relative to the board 22 as the cover 650 expands or contracts.

As shown in FIG. 15, a spaced distance separates each cover 650 from the covers 650 positioned on adjacent boards 22. These spaced distances can thus facilitate the flow of liquid off the upper surfaces of the covers 650 into the channels of the couplings 690. The spaced distance may vary depending on the particular application. In addition, the spaced distance between each corresponding pair of covers 650 may be substantially equal or uniform. In other exemplary embodiments, the spaced distance between each corresponding pair of covers 650 need not be the same but instead may vary.

Yet other embodiments do not include a spaced distance separating each corresponding pair of covers 650. By way of example, aspects of the present disclosure include the system 610 being used indoors or at other "dry" locations where facilitating drainage of fluids off the upper surfaces of the covers 650 is not really necessary. In one particular example, a system 610 is used in conjunction with plywood interior flooring. In such example, the system 610 may also be configured to provide structural reinforcement to the plywood interior floor such that the flooring is more structurally strong and sound than the plywood interior flooring alone.

With continued reference to FIG. 15, each cover 650 can also be individually retained by two couplings 690 on a board 22 independent of whether another cover 650 is being retained on an adjacent board 22. Therefore, a cover 650 can be retained on a board 22 by two couplings 690 without requiring engagement of another cover 650 to one of those two couplings 690.

In the illustrated embodiment, each channel 692 includes inward extensions or inwardly bent portions 694 for engaging the inwardly bent portions 662 of the side portions 658. The inwardly bent portions 662 have a transverse profile or cross-section that is a generally U-shape, whereas the inwardly bent portions 694 of the channels 692 have a cross-section that is a generally inverted U-shape. Other cross-sectional shapes (e.g., L-shaped, etc.) are also possible depending, for example, on the particular application in which the system 610 will be used. Further, other suitable methods of engaging and/or interlocking the covers 650 to the couplings 690 can also be employed.

To accommodate for contraction and/or expansion of the couplings 690, each coupling 690 includes fastener slots or oblong holes 696. The fastener slots 696 are spaced apart along a length of a flange 697 of the coupling 690. The fastener slots 697 allow a wide range of suitable fasteners 698

(e.g., nails, screws, etc.) to be inserted through the slots 696 and then fastened to the joist 24, thus attaching the coupling 690 to the joist 24. The fasteners 698 and slots 697 can be relatively configured (e.g., sized, shaped, etc.) to allow for at least some relative movement between a fastener and a fastener slot to thereby accommodate for at least some expansion and contraction of a coupling 690 relative to a board 22 and/or joist 24.

As shown in FIG. 16A, the couplings 690 may also include one or more outlets or openings 699 in a lower surface of the channel 692. The openings 699 can allow liquid (e.g., rainwater flowing into the channels 692 from off the cover top portions 656, spilled beverages, etc.) to drain out of the couplings 692 to an area under the deck.

Additionally, or alternatively, the deck on which the system 610 is installed can be provided with a gradient such that the deck slopes generally downwardly towards an outer side of the deck. The downward sloping or gradient can be provided by the deck components themselves and/or by constructing the deck on a generally downward sloping support surface.

By way of example, the couplings 690' shown in FIG. 16B do not include openings 699 in the lower channel surface. Instead, various embodiments include the couplings 690' being arranged such that their channels 692' slope generally downwardly along with the deck. This, in turn, facilitates flow of liquid (e.g., a spilled beverage, rainwater, water from other sources, etc.) through the channels 692' and ultimately out of the couplings 690'. In this exemplary manner, the channels 692' function similar to a gutter or trough directing the liquid away from the area under the deck.

The system 610 can be employed in the following exemplary manner. A first coupling 690 is attached to one or more joists 24 using the fastener slots 696 and fasteners 698. A floorboard 22 is positioned adjacent (and in some cases, in contact with and abutting against) the first coupling 690 and then attached to one or more joists 24. A second coupling 690 is positioned adjacent (and in some cases, in contact with and abutting against) the floorboard 22 and then attached to one or more joists 24 using fasteners 698 and slots 696. Positioning the floorboards 22 and couplings 690 in contact with one another during installation of the deck can make it easier for the installer to maintain generally uniform and consistent spacing between the floorboards 22 during the installation process.

A cover 650 can be positioned on the floorboard 22 such that the cover's inwardly bent portions 662 engage the inwardly bent portions 694 of the channels 692 of the first and second couplings 690 (which are positioned on opposite sides of the floorboard 22).

Figure 17:
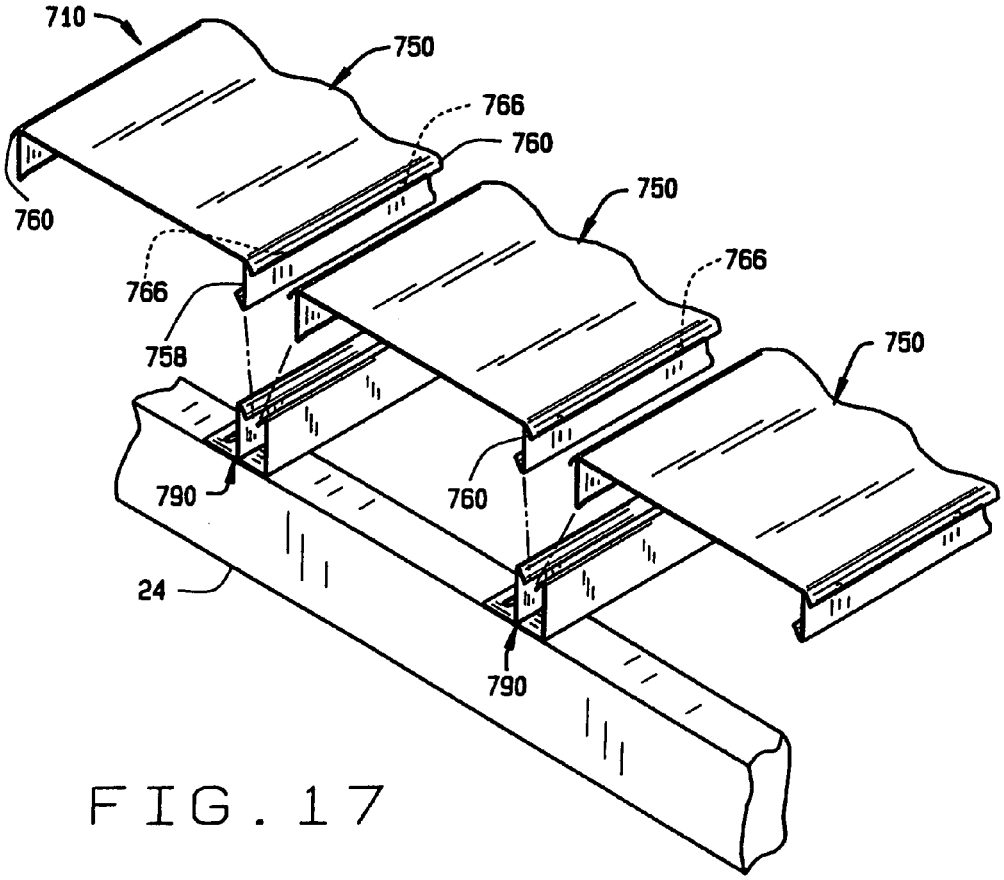
FIG. 17 is an exploded perspective view of a system for covering boards in a deck according to another embodiment of the present disclosure.

FIG. 17 illustrates another embodiment of a system 710 for covering components or boards (e.g., floorboards 22, etc.) of a deck. As shown in FIG. 17, the system 710 includes covers 750 and couplings 790. Each coupling 790 is adapted to be coupled to at least one joist 24 and is sized to be positioned between at least two adjacent floorboards 22.

Each cover 750 includes overhangs 760 curving generally downwardly from each side edge of the cover's top portion. Alternatively, the cover may include more or less overhangs and/or overhangs configured differently (e.g., sized, shaped, etc.) than what is shown in FIG. 17. For example, other embodiments include only one overhang, no overhangs, or one or more overhangs that are generally straight, that are generally horizontal, that extend generally diagonally in a downwardly direction, combinations thereof, etc.

In addition, each cover 750 as shown also includes holes 766 in its side portions 758 for venting moisture from an area between the cover 750 and the board 22 when the cover 750 is positioned on the board 22. In the illustrated embodiment of FIG. 17, the overhangs 760 project downwardly to at least the location of the holes 766. This allows the overhangs 760 to at least partially cover the holes 766, for example, to inhibit moisture (e.g., water from rain or from cleaning the deck) from entering the holes 766.

In any one or more of the various embodiments of the present disclosure, a cover (e.g., 50, 150, 250, 350, 450, 550, 650, 750, 850, 950, etc.) may include an underside provided with one or more striations, grooves, ridges, ribs, ripples, pebble-toned portions, bumps, roughened portions, etc. for creating at least one spaced distance or gaps generally between at least a portion of the cover's underside and the top surface of the board (or other component) on which the cover is positioned. This spaced distance or gap can help facilitate or allow an airflow or air circulation, which, in turn, can help direct or channel moisture collected on the cover's underside towards through-holes or openings (e.g., 166, 366, 466, 766, 866, 966, 1066, etc.) in the cover's side portion for allowing the venting of moisture.

Figure 18:
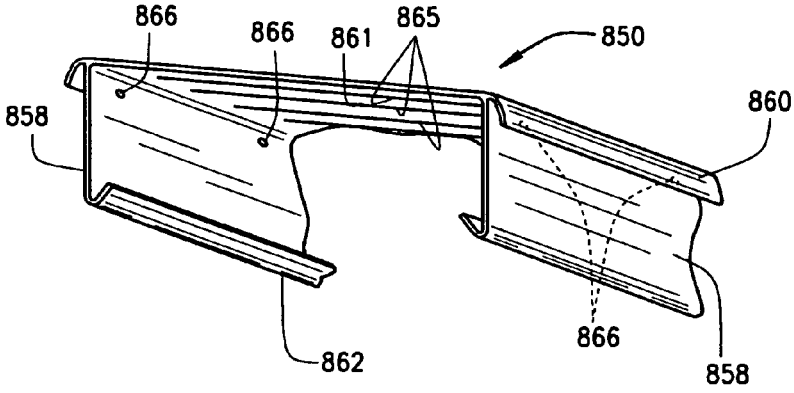
FIG. 18 is a perspective view of an exemplary cover according to another embodiment of the present disclosure.

FIG. 18 illustrates an exemplary embodiment of a cover 850 having a striated or ribbed underside 861. As shown in FIG. 18, the cover 850 includes striations, ridges, or ribs extending generally parallel with one another and extending at least partially between the cover's side portions 858. Alternatively, the striations, ribs, or ridges 865 may be provided in other configurations than what is shown in FIG. 18. For example, the striations, ridges, or ribs may be provided such that they extend at acute or oblique angles relative to the cover's side portions. Or, for example, other embodiments can include striations, ridges, or ribs that are not parallel with one another and/or that are not perpendicular to the cover's side portions.

The striations, raised ridges, or ribs 865 can be configured for creating and/or maintaining at least one gap or spaced distance generally between at least a portion of the cover's underside 861 and the top surface of the board (or other component) on which the cover is positioned. In this particular embodiment, the recessed portions or grooves defined generally between corresponding pairs of the raised ridges 865 can help facilitate and allow an airflow or air circulation. This, in turn, can help direct or channel moisture collected on the cover's underside 861 generally towards through-holes or openings 866 in the cover's side portions 858 for allowing moisture venting. Accordingly, the striations, ridges, or ribs 865 and through-holes 866 can help facilitate the venting or escape of moisture from within the interior of the cover 850.

FIG. 18 further illustrates the cover 850 having overhangs 860. In other embodiments, the cover 850 may also include through-holes in the bottommost portions of the u-shaped engagement members 862, which may allow liquid to drain from the engagement portions 862. In still other embodiments, a cover may include a striated, ribbed, roughened, or pebble-toned underside without any overhangs, u-shaped engagement members, or through-holes in the engagement members.

Figure 19:
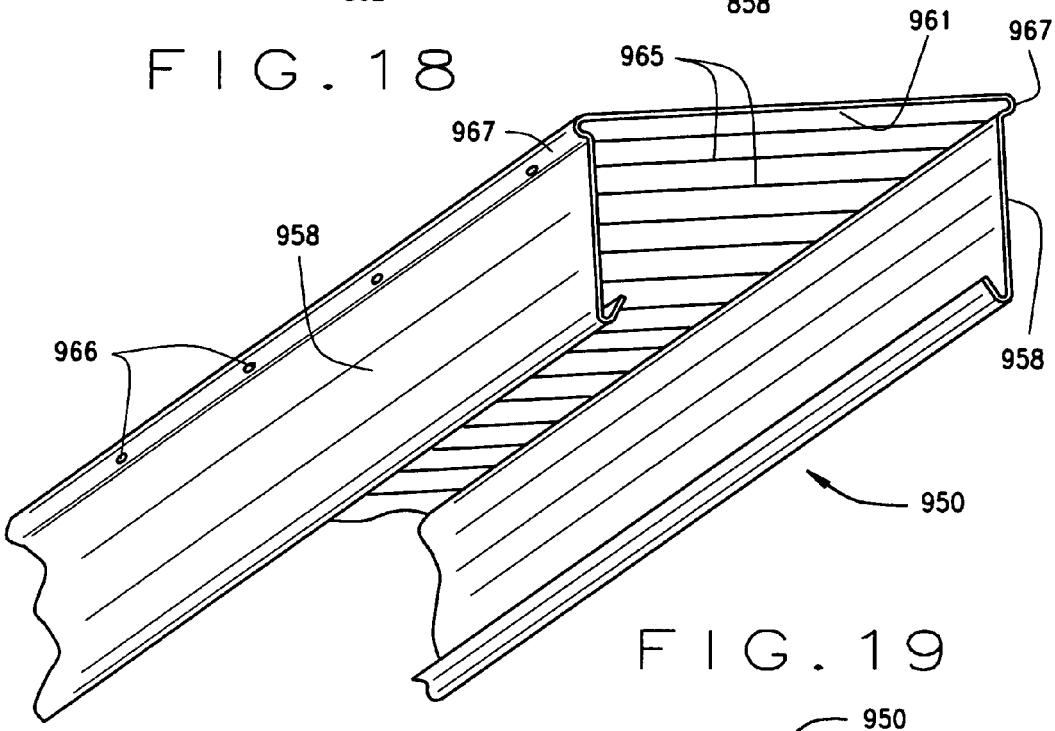
FIG. 19 is a perspective view of an exemplary cover according to another embodiment of the present disclosure.
Figure 20:
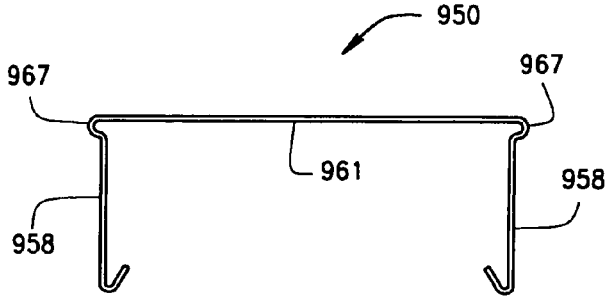
FIG. 20 is an elevation view of the cover shown in FIG. 19.

With reference now to FIG. 19, there is shown another exemplary embodiment of a cover 950 having a striated or ribbed underside 961. As shown in FIG. 19, the cover 950 includes striations, raised ridges, or ribs 965 extending generally parallel with one another and extending at least partially between the cover's side portions 958. Alternatively, the striations, ridges, or ribs may be provided in other configurations than what is shown in FIGS. 19 and 20. For example, the striations, ridges, or ribs may be provided such that they extend at acute or oblique angles relative to the cover's side portions. Or, for example, other embodiments can include striations, ridges, or ribs that are not parallel with one another and/or that are not perpendicular to the cover's side portions.

The striations, raised ridges, or ribs 965 can be configured for creating and/or maintaining at least one gap or spaced distance generally between at least a portion of the cover's underside 961 and the top surface of the board (or other component) on which the cover is positioned. In this particular embodiment, the recessed portions defined generally between corresponding pairs of the raised ridges 965 can help facilitate or allow an airflow or air circulation. This, in turn, can help direct or channel moisture collected on the cover's underside 961 generally towards the cover's side portions 958.

The cover 950 also includes one or more collection channels 967 extending at least a partially along the cover's side portions 958. As shown in FIG. 20, the collection channels 967 have cross-sections or transverse profiles that are generally C-shaped. Alternatively, other cross-sectional shapes are also possible for the collection channels 967.

As shown in FIG. 19, through-holes 966 are provided in the collection channels 967. Depending on their configuration (e.g., particular location, size, shape, etc.), the through-holes 966 can allow drainage of liquid and/or venting of vapor from a collection channel 967. For example, one or more through-holes 966 may be provided along an upper portion and/or middle portion of a collection channel 967 to allow venting of vapor. Additionally, or alternatively, one or more through-holes 966 may be provided along a lower portion of a collection channel 967 to allow drainage of liquid from the collection channel. Accordingly, the striations, ribs, or ridges 965, collection channels 967, and through-holes 966 in the collection channels 967 can help facilitate drainage of liquid and/or venting of moisture from within the interior of the cover 950. While the cover 950 is not shown with any overhangs or shrouds, other embodiments include the cover 950 being provided with an overhang or shroud along each side edge of the cover's top portion.

In some embodiments, the cover 950 may be installed on a component having a gradient such that the collection channels 967 of the installed cover 950 will have a slope generally downwardly in one direction. The downward sloping or gradient can be provided by the deck component itself and/or by constructing the deck on a generally downward sloping support surface (e.g., yard, etc.). In these examples, the downward sloping can facilitate flow of liquid through the collection channels 967 and ultimately out open ends the collection channels 967. In this exemplary manner, the collection channels 967 can function similar to a gutter or trough directing liquid out from the interior of the cover 950.

Figure 21:
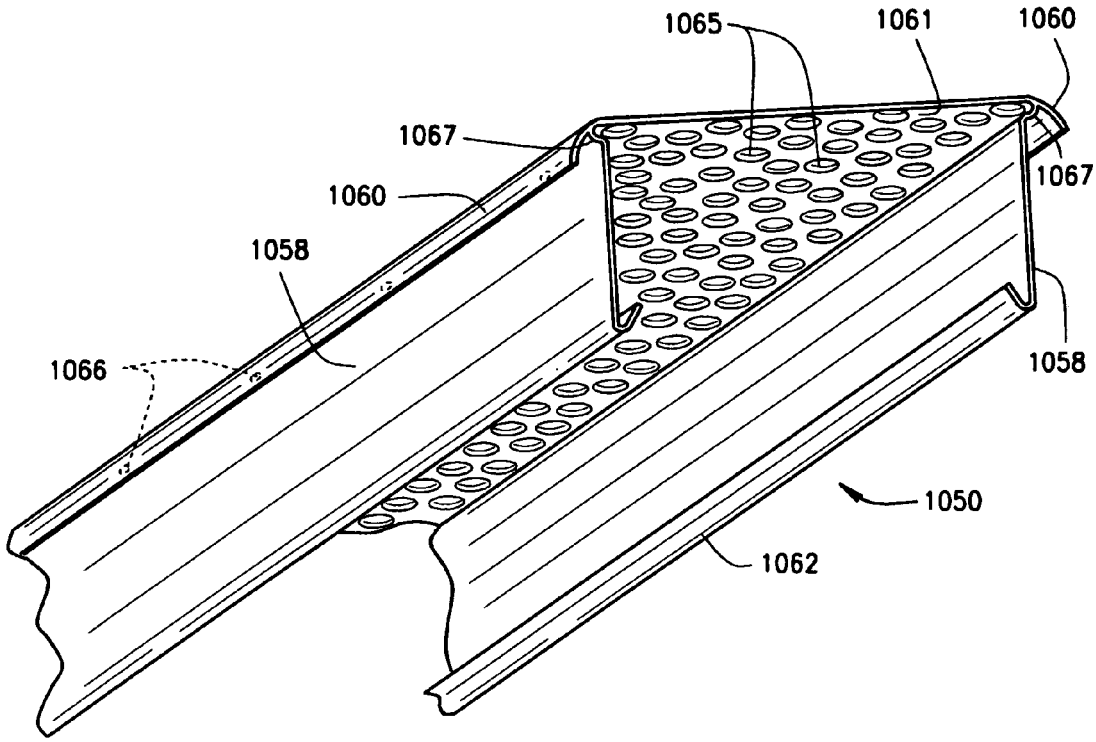
FIG. 21 is a perspective view of an exemplary cover according to another embodiment of the present disclosure.

FIGS. 20 and 21 illustrate an exemplary embodiment of a cover 1050 having a roughened, bumpy, or pebble-toned underside 1061. As shown in FIG. 20, the cover's roughened, bumpy or pebble-toned underside 1061 configured for creating and/or maintaining at least one gap or spaced distance generally between at least a portion of the cover's underside 1061 and the top surface of the board (or other component) on which the cover is positioned. Accordingly, the underside 1061 can help facilitate or allow an airflow or air circulation. This, in turn, can help direct or channel moisture collected on the cover's underside 1061 generally towards the cover's side portions 1058.

Figure 22:
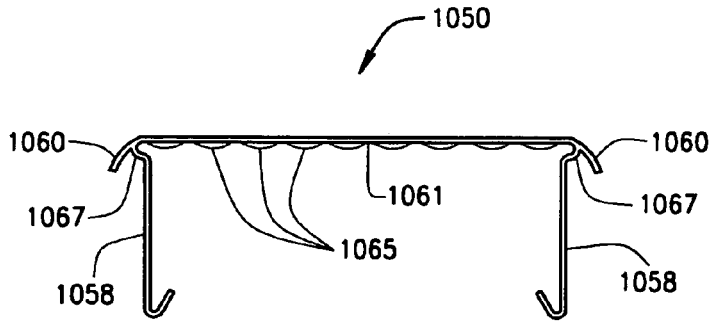
FIG. 22 is an elevation view of the cover shown in FIG. 21.

FIGS. 21 and 22 further illustrates the cover 1050 having overhangs or shrouds 1060. In other embodiments, the cover 1050 may also include through-holes in the bottommost portions of the u-shaped engagement members 1062, which may allow liquid to drain from the engagement portions 1062. In other embodiments, however, a cover may include a roughened, bumpy, or pebble-toned underside without any overhangs, u-shaped engagement members, or through-holes in the engagement members.

The cover 1050 also includes collection channels 1067 extending at least a partially along the cover's side portions 1058. As shown in FIG. 22, the collection channels 1067 have cross-sectional or transverse profiles that are generally C-shaped. Other cross-sectional shapes are also possible for the collection channels 1067.

One or more through-holes 1066 are provided in the collection channels 1067. Depending on their configuration (e.g., particular location, size, shape, etc.), the through-holes 1066 can allow liquid drainage and/or vapor venting from a collection channel 1067. In this particular embodiment, through-holes 1066 are shown provided along the lower portions of the collection channels 1067 to allow vapor venting and/or liquid drainage from the collection channels 1067. Additionally, or alternatively, one or more through-holes may be provided along an upper portion and/or middle portion of a collection channel 1067. Or, for example, one or more through-holes may be provided at other locations besides within the collection channels 1067, such as along the sidewall portions 1058 through a vertical portion of the sidewall portion 1058 generally below the collection channel 1067. Accordingly, the roughened, bumpy, or pebble-toned underside 1061, collection channels 1067, and through-holes 1066 in the collection channels 1067 can help facilitate liquid drainage and/or moisture venting from within the interior of the cover 1050.

In some embodiments, the cover 1050 may be installed on a component having a gradient such that the collection channels 1067 of the installed cover 1050 will have a slope generally downwardly in one direction. The downward sloping or gradient can be provided by the deck component itself and/or by constructing the deck on a generally downward sloping support surface (e.g., yard, etc.). In these examples, the downward sloping can facilitate flow of liquid through the collection channels 1067 and ultimately out open ends of the collection channels 1067. In this exemplary manner, the collection channels 1067 can function similar to a gutter or trough directing liquid out from the interior of the cover 1050.

Additionally, or alternatively, a cover (e.g., 50, 150, 250, 350, 450, 550, 650, 750, 850, 950, 1050, etc.) may include an underside having a generally concave configuration for helping direct or channel moisture collected on the cover's underside towards through-holes (etc., 166, 366, 466, 766, 866, 966, 1066, etc.). In such embodiments, the cover may also have a convex upper surface that facilitates the flow of liquid off the cover's upper surface. The convex upper surface may be configured for nesting engagement with a concave lower surface of another cover so that a plurality of covers may be conveniently stacked one on top of the other. The convex upper surface can have a slightly rounded or curved configuration from a longitudinal center line of the cover for shedding water, but which is still comfortable to walk upon.

In various embodiments of the present disclosure, one or more splicers, wall attachments, receivers, or tie-ins, end caps, and/or edge caps may be used. For example, wall attachments, receivers, or tie-ins may be positioned within a space separating the deck (or a cover thereon) from a wall of the house. Or, for example, end caps or edge caps may be used for sealing off the ends of the floorboards, which, in turn, are also being covered by one or more covers of the present disclosure. As another example, a splicer may be positioned generally between two covers of the present disclosure, which are, in turn, positioned on the same floorboard, wherein the splicer bridges or fills a gap between the two covers. Any one or more of these accessory items (e.g., splicers, wall attachments, receiver, or tie-ins, end caps, edge caps, etc.) can include fastener slots or oblong holes to accommodate for at least some contraction and/or expansion of the accessory item, such as a plastic accessory item. Such fastener slots may be spaced apart along a length of a flange of the accessory item. The fastener slots may allow a wide range of suitable fasteners (e.g., nails, screws, etc.) to be inserted through the slots and then fastened to a joist, floorboard, wall, or other structural component, thus attaching the accessory item thereto. The fasteners and slots can be relatively configured (e.g., sized, shaped, etc.) to allow for at least some relative movement between a fastener and a fastener slot to thereby accommodate for at least some expansion and contraction of the accessory item relative to the joist, floorboard, wall, or other component to which the accessory item is attached.

Other aspects of the present disclosure relate to methods of covering a deck, such as an outdoor patio deck. In one particular embodiment, a method for covering a deck generally includes positioning one or more plywood boards on the floorboards of a deck, and positioning a cover on the plywood boards.

Various embodiments of the present disclosure are not limited to use with wood boards or structural members of a particular type, size, and shape. Embodiments of the present disclosure can be used with, for example, solid wood boards, composite wood boards, metal boards or beams, corrugated steel floor members, and floor members constructed of other types of composite materials. In certain embodiments, the underlying structural member on which a cover is positioned is formed of corrugated steel.

In addition, any of the various covers of the present disclosure can be constructed of a particular size corresponding to the length and width of the board or component on which the cover will be installed. Alternately, the cover (after it is constructed) may be cut to the length of the board or other component on which it will be installed.

A wide range of materials can be used for the embodiments of the present disclosure, such as vinyl materials, nylons, plastics (e.g., polyvinyl chloride, etc.), extrudable materials, weather durable materials, etc. By way of example only, a flexible vinyl material is used for at least one of the covers or couplings shown and/or described herein, which allows the cover to expand and contract in response to changing weather conditions. A wide range of colors can also be used for any of the various components comprising one of the covers or couplings of the present disclosure.

In at least some embodiments, a cover has a monolithic construction in which the cover's top and side portions are integrally formed as a single component (e.g., as a single extruded plastic piece, etc.). Alternatively, different or additional component parts constructed of different materials can be used for a cover or a coupling of the present disclosure. For example, a cover may include a top portion and side portions that are separate components secured to one another, for example, by welding and/or other suitable fastening methods.

Any of the covers of the present disclosure can also include different textured top portions or treads, for example, to at least reduce the likelihood of a user slipping when walking on the top portion.

Accordingly, embodiments of the present disclosure provide covers that can be readily and securely installed on the boards of a deck (and elsewhere) without the need for glue or other adhesive type material. This, in turn, can allow the covers to expand and/or contract relative to the boards provided with such covers. Further, various embodiments include a cover constructed slightly larger than the board to provide a gap between the cover and the board to accommodate at least some contraction of the cover relative to the board.

Any of the various covers can be readily installed with relative ease. Such exemplary covers can also be readily removed and replaced, for example, for repair and/or for aesthetic considerations. A user can install or replace covers to change the appearance of a deck, for example, to make the deck's appearance more consistent with surrounding features, such as the siding on a house.

Various embodiments of the present disclosure can protect boards of a deck from external conditions (e.g., weather, scuffing and other wear and tear through use of the deck, etc.). A deck provided with one or more covers in accordance with the present disclosure may also require less on-going maintenance. By protecting a deck from external conditions, various embodiments of the present disclosure can help eliminate, or at least reduce, the need for use of treated wood, which may have been impregnated with toxic chemicals (e.g., arsenic), thus making decks safer to use. Various embodiments can also make decks safer by protecting bare foot users from wood splinters and protruding fasteners, such as raised nails.

Various embodiments can also allow boards and components made from a wide range of materials to be used for a deck, including construction grade plywood flooring, wood composite boards, metal components, and/or untreated wood pine board. Various embodiments of the present disclosure can also allow the costs associated with building decks to be reduced because relatively inexpensive materials or substrates can be used for the underlying structural members, which are then provided with and protected by one or more covers of the present disclosure. For example, various embodiments can use relatively inexpensive wood for the underlying structural members, which are then provided with plastic covers. In such exemplary embodiments, a relatively inexpensive plastic material can be used for the plastic covers because the underlying wood components can provide sufficient structural support for the deck without requiring the plastic covers themselves to provide structural support for the deck. Accordingly, various exemplary embodiments can be considerably less expensive than an entirely wooden deck or entirely plastic deck.

Plus, the standard wood nails that are typically used with entirely wooden deck constructions often loosen from the wood and become raised due to expansion and/or contraction of the wood components over time. Entirely plastic deck constructions can also have exposed fasteners as well. These exposed fasteners (e.g., raised nails, etc.) can result in a potentially dangerous condition that may cause injury to users of the deck (e.g., injury to a user's foot while walking on the deck, etc.). In various embodiments of the present disclosure, covers can be attached to boards (or other deck components) without using mechanical fasteners such that there are no exposed mechanical fasteners on the walking surface. In such embodiments, the covers may also be positioned to cover any mechanical fasteners used for the underlying deck components. Accordingly, these exemplary embodiments can provide a safer and more aesthetically pleasing deck.

In view of the foregoing, aspects of the present disclosure relate to and includes covers having one or more of the following: overhangs; notches or slots for accommodating another board beneath the board on which the cover will be positioned; a top portion having an upper surface sloping generally downwardly from a middle portion towards its side edges; holes for venting moisture from an area between the cover and the board when the cover is positioned on the board;

and/or covers adapted for use with couplings as described above. Aspects of the present disclosure further include boards provided with at least one or more of such covers, deck-like structures provided with at least one or more of such covers, and methods of applying at least one or more of such covers to a board, a flooring component (internal or external), decks, docks, wharfs, floors (both internal and external), and the like. In addition, any one or more of aspects of the present disclosure may be implemented individually or in any combination with any one or more of the other aspects of the present disclosure.

It is anticipated that embodiments of the present disclosure will be used in a wide range of outdoor decks, indoor decks, docks, wharfs, internal floors, external floors, and the like. Accordingly, the specific references to deck herein should not be construed as limiting the scope of the present disclosure.

Certain terminology is used herein for purposes of reference only, and thus is not intended to be limiting. For example, terms such as "upper", "lower", "above", and "below" refer to directions in the drawings to which reference is made. Terms such as "front", "back", "top", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order or performance. It is also to be understood that additional or alternative steps may be employed.

The description of the disclosure is merely exemplary in nature and, thus, variations that do not depart from the gist of the disclosure are intended to be within the scope of the disclosure. Such variations are not to be regarded as a departure from the spirit and scope of the disclosure.

What is claimed is:

1. A cover for an outdoor deck component having a top, a bottom, and sides, the cover comprising an upper portion and generally downwardly extending side portions, the cover's upper and side portions configured to generally cover at least the top and sides of the outdoor deck component, at least one of the cover's side portions including at least one through-hole configured to allow venting of moisture from an area between the cover and the outdoor deck component when the cover is positioned on the outdoor deck component, wherein the cover's upper portion includes side edges, and wherein the cover includes at least one overhang extending generally outwardly from at least one of said side edges.

2. The cover of claim 1, wherein the at least one overhang at least partially covers the at least one through-hole.

3. The cover of claim 1, wherein the at least one overhang curves generally downwardly and forms a drip edge to facilitate the flow of liquid off the cover's upper portion.

4. A system for covering an outdoor deck component having first and second sides, the system comprising at least a first cover and at least first and second couplings, each said first and second coupling including a channel and configured to engage a corresponding portion of the first cover for retaining the first cover on the outdoor deck component with a spaced distance separating the first cover from at least one other cover retained by the first or second coupling on an adjacent outdoor deck component, the spaced distance allowing liquid to flow off an upper surface of the first cover into the channel of the corresponding first or second coupling.

5. The system of claim 4, wherein the first cover and the first and second couplings are configured such that the first cover can be individually retained by the first and second couplings on the outdoor deck component independent of and without requiring engagement of another cover to the first or second coupling.

6. The system of claim 5, wherein the channels include inward extensions for engaging corresponding inward extensions of the first cover to thereby inhibit removal of the first cover from the outdoor deck component.

7. The system of claim 4, wherein the first cover includes an upper portion and generally downwardly extending side portions, at least one of the first cover's side portions including at least one through-hole configured to allow venting of moisture from an area between the first cover and the outdoor deck component when the first cover is being retained on the outdoor deck component by the first and second couplings.

8. The system of claim 7, wherein the first cover's upper portion includes side edges, and wherein the first cover includes at least one overhang extending generally outwardly from at least one of said side edges such that at least one overhang at least partially covers the at least one through-hole.

9. The system of claim 7, wherein the first cover's upper portion includes an underside configured for maintaining at least one gap between the cover's underside and the top of the outdoor deck component for facilitating an airflow and channeling of moisture collected on the first cover's underside towards the at least one through-hole.

10. The system of claim 9, wherein the first cover's underside includes at least one raised portion for maintaining the at least one gap.

11. The system of claim 4, wherein the first cover includes an upper portion having side edges, and at least one overhang extending generally outwardly from at least one of said side edges.

12. The system of claim 11, wherein the at least one overhang curves generally downwardly and forms a drip edge to facilitate the flow of liquid off the first cover's upper portion into at least one of said channels of the first and second couplings.

13. The system of claim 4, wherein the first cover includes an upper portion having side edges and a surface sloping generally towards at least one of the side edges to thereby facilitate liquid drainage from the first cover's upper portion into at least one of said channels of the first and second couplings.

14. The system of claim 4, wherein at least one of said channels slopes generally downward towards an open end of the channel to allow a liquid to flow through and out the open end of the channel.

15. The system of claim 14, wherein the channel's slope is provided at least partially by at least one of:

a gradient integral to the outdoor deck component; and a gradient of the surface supporting the outdoor deck component.

16. The system of claim 4, wherein at least one of said channels includes at least one through-hole for allowing liquid to drain out of the channel.

17. The system of claim 4, wherein at least one of said first and second couplings include at least one fastener slot configured to receive at least one fastener therein for attachment to an outdoor deck component and to allow at least some relative movement between the fastener and the fastener slot to thereby accommodate for at least some expansion and contraction of the at least one of said first and second couplings.

18. An outdoor deck including the system of claim 4.

19. The outdoor deck of claim 18, further comprising a plurality of floorboards, and wherein each said first and second coupling is positioned between and in contact with a corresponding pair of the floorboards, the first and second couplings being sized to provide generally uniform spacing between the floorboards.

20. A method for covering at least a portion of an outdoor deck, the method comprising engaging a plurality of couplings having channels with at least one joist of the outdoor deck such that each coupling is adjacent a corresponding side of at least one floorboard of the outdoor deck, positioning a first cover on a first floorboard of the outdoor deck such that portions of the first cover are received and retained within the channels of the couplings adjacent the sides of the first floorboard, and positioning a second cover on a second floorboard of the outdoor deck such that portions of the second cover are received and retained within the channels of the couplings adjacent the sides of the second floorboard, and such that a spaced distance separates the first cover from the second cover thereby allowing liquid to flow off of the first and second cover's top portions into the channels.

21. The method of claim 20, wherein the engaging comprises positioning at least one coupling between and in contact with each corresponding pair of floorboards to provide generally uniform spacing between the floorboards.

* * * * *